US005741562A

United States Patent [19]

Scatterday

[11] Patent Number: 5,741,562

[45] Date of Patent: Apr. 21, 1998

[54] ARTIFICIAL FLOWER

[76] Inventor: Mary L. Scatterday, 6443 N. 77th Pl., Scottsdale, Ariz. 95250

[21] Appl. No.: 587,555

[22] Filed: Jan. 17, 1996

[51] Int. Cl.[6] ..... A41G 1/00

[52] U.S. Cl. ..... 428/24; 156/61; 428/26

[58] Field of Search ..... 428/24, 25, 26; 156/61; 362/122

[56] References Cited

U.S. PATENT DOCUMENTS

| | | | |
|---|---|---|---|
| D. 225,119 | 11/1972 | Tartar | 428/18 X |
| 1,458,513 | 1/1923 | Bell | 428/26 |
| 1,748,636 | 2/1930 | Crockett | 428/26 |
| 1,942,174 | 1/1934 | Kaplan | 428/26 |
| 3,030,719 | 4/1962 | Enomoto | 428/26 |
| 3,565,736 | 2/1971 | Jason | 428/26 |
| 3,575,774 | 4/1971 | Vest | 428/26 X |
| 4,324,821 | 4/1982 | Heineman, III | 428/24 |
| 4,776,511 | 10/1988 | Tischer | 428/24 X |
| 4,888,221 | 12/1989 | Tischer | 428/18 |

*Primary Examiner*—Henry F. Epstein
*Attorney, Agent, or Firm*—Schmeiser,Olsen&Watts

[57] ABSTRACT

Articles emulative of, and methods for making, artificial roses. Non-destructive, dry fashioning methods are used to produce artificial rose buds and fuller rose blooms from (a) rectangular sheet(s) of foldable and creasable material. A bud is made by various formative methods that create, in the first instance, an essentially tubular construct, one end of which is crimped and wound with florist wire, and the other end which appears with petal-like curls and pseudo-involution. Petal pairs made of a single sheet of the material are added, as desired, to acquire more mature-looking rose blooms. Throughout the method, no cutting, gluing or other mutilation of the workpiece sheet is employed.

8 Claims, 3 Drawing Sheets

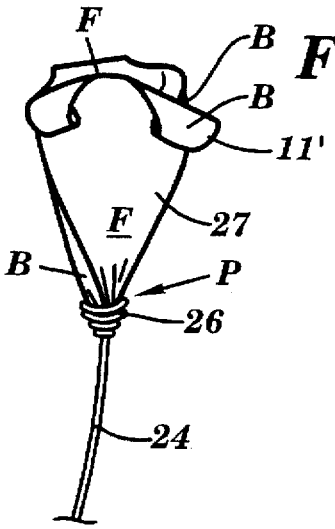
FIG. 5
FIG. 6A
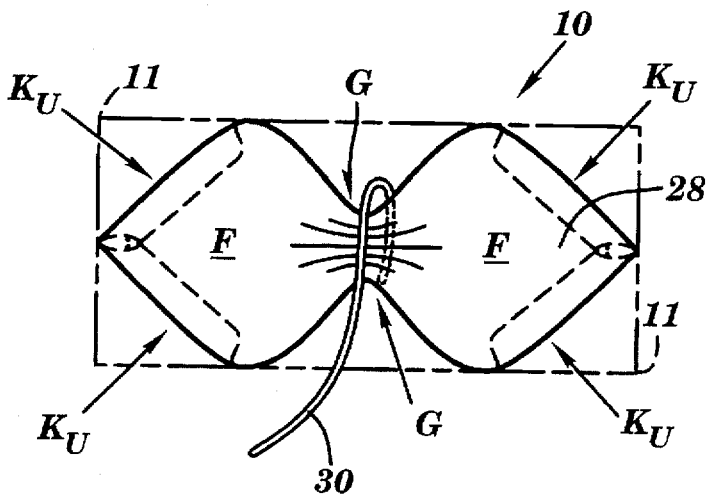
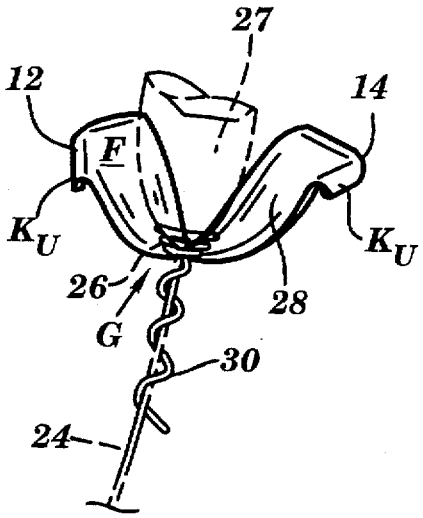
FIG. 6B
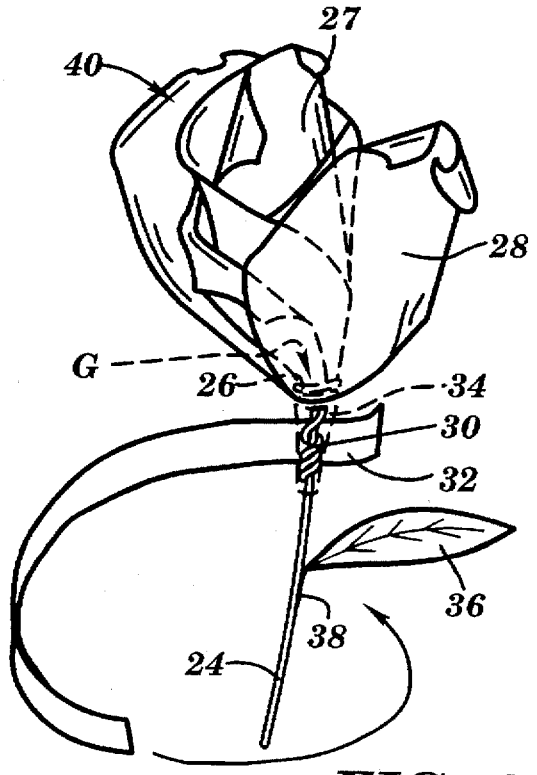
FIG. 7

ARTIFICIAL FLOWER

BACKGROUND OF THE INVENTION

1. Field of the Invention

This invention relates, generally, to an article and method for making it by constructing the same from sheets of parchment, paper or other formable and foldable fabric. Specifically, the invention method fashions an artificial rose from sized material sheets, which may include currency or negotiable paper, without cutting, defacing or otherwise mutilating the sheets.

2. Description of Relevant Art

Use of material sheets, such as denoted in 1. Field of the Invention, for construction of festoons, wrapping ensembles, artificial structures and the like, is well known in the art. So too is the use of currency to effect the various constructions. With very few exceptions, most artists contemplate cutting or adhering the sheets so as to mutilate or destroy portions thereof. Our invention is directed towards a non-destructive construction method that will produce an artificial rose which, if constructed of valuable paper, will retain its intrinsic value to supplement its aesthetic richness.

U.S. Pat. No. 1,942,174 discloses a method for making a material and its usage for making decorative devices such as artificial flowers, flower parts, etc. Essentially, this disclosure details the method of introducing sizing to a planar sheet of material by a lamination process. When used to form leaves, petals and other flower parts, the basic workpieces are cut and shaped. Thus, the workpiece looses much of its original identity and resulting value is found in the assembled material sheets or the flowers made therefrom. Were the initial sheet to have been valuable paper, all intrinsic value would have been lost. Also disclosed in '174 is an artificial leaf that is commonly used in the flower decorative art. A method of producing artificial flower petals is disclosed in U.S. Pat. No. 1,458,513 and shows a technique for curling the corners of planar fabric sheets to acquire shapes emulative of flower petals. Since the patent is directed only toward a method of producing artificial flower petals, there is no further disclosure on how such petals may be gathered to form a particular flower. Additionally, '513 requires soaking of the workpiece material, a ribbonous, sized fabric.

Similar to festoon art, U.S. Pat. No. 3,565,736 discloses a method for making a paper flower by cutting a fabric, pleating it several times and gathering the pleats at a waist portion of the pleated fabric. After securing the gather, the various pleats are fanned outwardly and radially, characteristic of the festoon, to effect a circular geometry. Similar to '736, but avoiding any mutilation or defacement of the sheet material, is U.S. Pat. No. 4,888,221, showing the construction of a money tree. Most significant to us in this patent is the showing of United States currency as the material sheet which is pleated, waist-gathered and secured so as to imitate the festoon of '736. Finally, U.S. Pat. No. 1,748,636 shows a means for making artificial flowers largely from rubber or rubber compounds. The production method requires rubber forms, coating procedures and cutting processes and results principly in the production of a calyx from which depends a flower stem.

As we shall point out in greater detail hereinafter, our invention differs significantly from the prior art employed for making artificial flowers, specifically roses, in that one embodiment of the finished product employs negotiable paper, such as currency, which cannot be defaced or mutilated. Since the product will be used as a gift, where currency is used, we would hope to retain the intrinsic value of the material sheets that we term the workpieces of our invention method.

3. Incorporation by Reference

Because they disclose articles and methods for making the same that are relevant to our own invention, U.S. Pat. Nos. 1,458,513, 1,748,636, 1,942,174, 3,565,736 and 4,888,221 are hereinafter incorporated by reference.

SUMMARY OF THE INVENTION

Limitations of the prior art have been avoided in our method for fashioning, without mutilating, an artificial flower bud and a finished flower from rectangular sheets of sized material that possess foldability and creaseability qualities. A first sheet is shaped into an essentially tubular structure that is pinched or gathered at the bottom and made into a structure that, with the use of floral tape, is made emulative of a flower calyx. The upper portions of the tubular shape are curled in a manner similar to a rose petal. Unlike much of the prior art artificial roses, our flower petals curl essentially downward from their uppermost part. Thus, with but a single sheet workpiece, we acquire a bud having a calyx form and a stem wire. The calyx form and wire may be finished with floral tape, and include prefabricated artificial leaves using techniques well known in the trade.

After the calyx form is made, and before any finishing is accomplished, additional petal pairs are generally added to the bud structure by attaching them to the calyx form and stem wire raddeling. When a desired number of petal pairs have been added, to acquire the desired flower size, the remaining, exposed calyx form and stem wire are finished, as above.

Because no mutilation of the workpiece(s) takes place when using our method, it is an excellent one for use in making artificial flowers, particularly roses, out of valuable paper such as national currency, gift certificates, coupons, etc. Ideally, such paper possesses the sizing (finishing) characteristics as well as the physical dimensions for fashioning artificial roses of the hybrid tea variety. Both buds and full flowers are amazingly lifelike and quite beautiful when executed, alternatively, with colored fabric, parchment or paper.

BRIEF DESCRIPTION OF THE DRAWINGS

Of The Drawings:

FIG. 5 illustrates an involute formation of an essentially tubular shaped bud made by the preferred method;

FIG. 6A illustrates preparation of a petal pair;

FIG. 6B shows attachment of a petal pair to a bud; and

FIG. 7 illustrates a formation of a complete artificial rose acquired through use of both the preferred and alternate embodiment methods.

DETAILED DESCRIPTION OF THE PREFERRED EMBODIMENT

Before commencing the details of our invention, we would point out that our original preference for fashioning an artificial flower of the invention considered the use of national currency. It is illegal to deface, mutilate or otherwise destroy the paper currency of the United States, so we devised a method which is completely nondestructive of the workpieces, i.e., currency notes. Not surprisingly, we also discovered that the standard United States currency note provides rectangular sheets of the best available fabric/paper, having both sizing (foldability and shape retention) characteristics as well as desirable dimensions (length-to-width ratio of about 2.5:1.0). Of course, other materials may be used for the workpiece sheets of this invention so long as they possess the attributes necessary to acquire the finished products. Thus, colored sheets, parchment, sized fabric such as silk, etc. may be used alternatively.

1. Definitions calyx form (n.) means a wire-secured pinch or crimp of sheet material that provides form for florist type tape coverage, in emulation of a botanical calyx;

compression (n. means a squeezed or pinched portion of a sheet of material;

pinch (n.) means a compression;

sizing (n. and v.t) means the quality of, or a making of, a fabric or paper with foldability and distortion-retaining characteristics necessary to the invention; and waist (n.) means the middle portion of the length dimension of a rectangular sheet used in the invention.

2. Methodology

Figure 1:
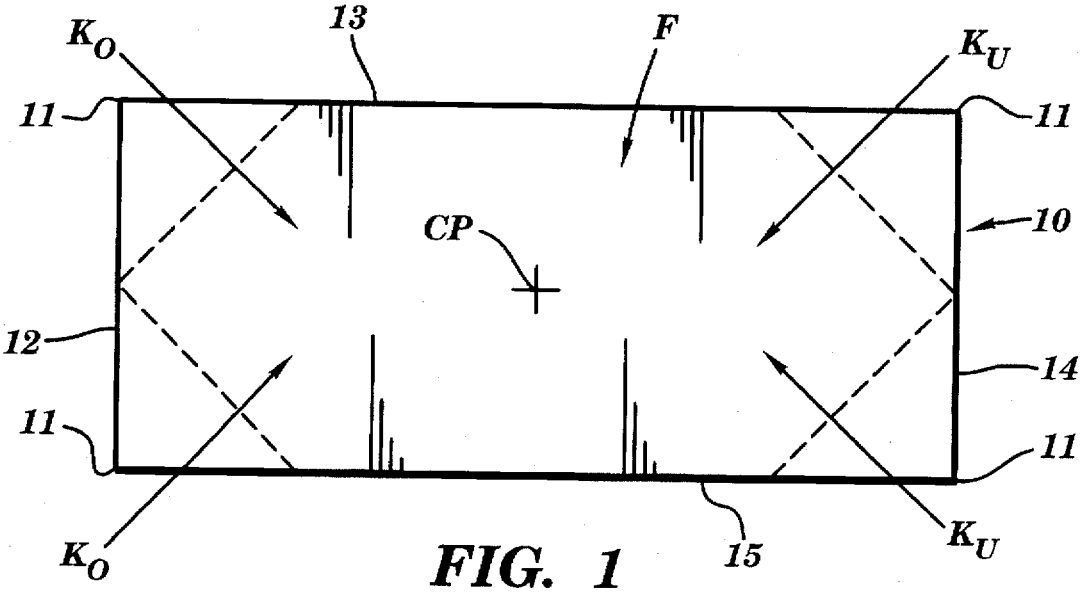
FIG. 1 illustrates a sheet of fabric/paper detailing the invention method.
Figure 2:
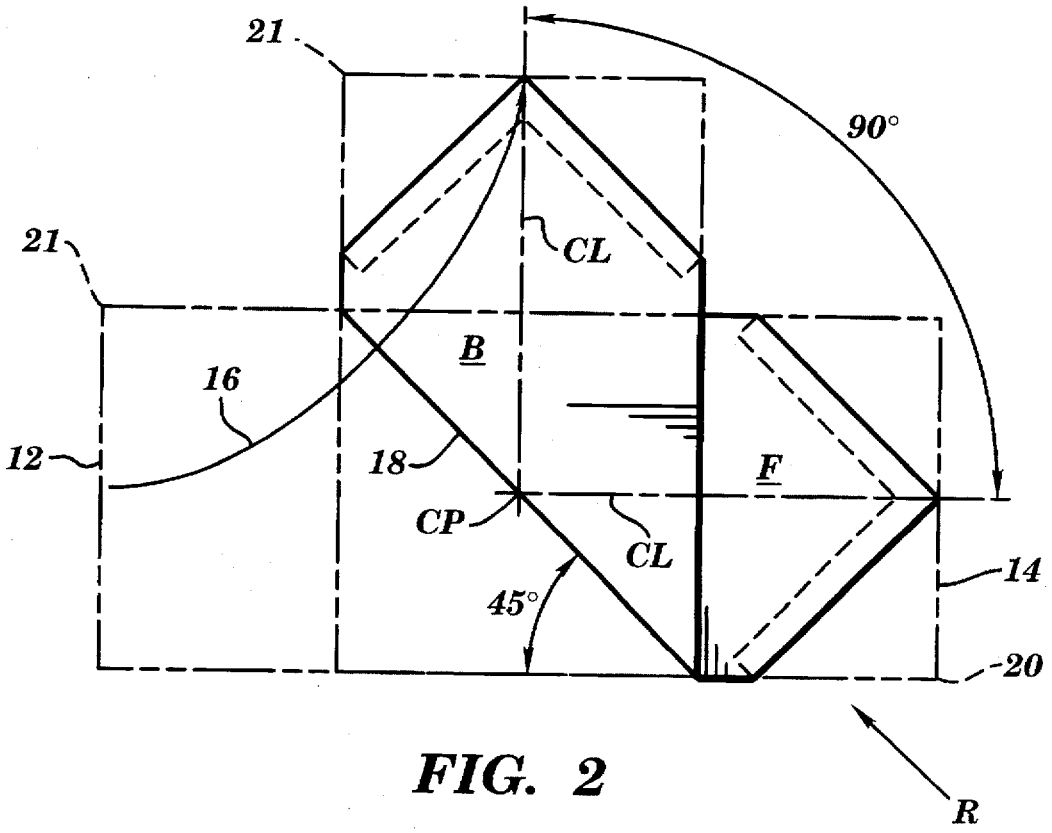
FIG. 2 illustrates the FIG. 1 sheet manipulated through two steps of the preferred embodiment method.
Figure 3:
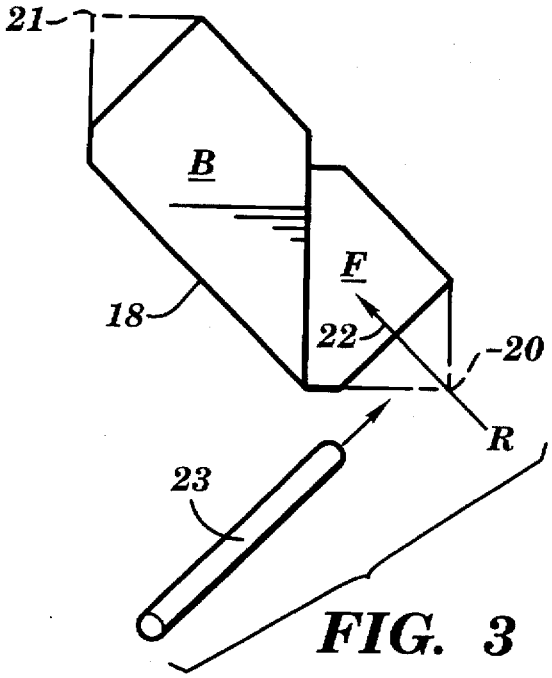
FIG. 3 illustrates the FIG. 2 sheet being processed in another step of the preferred embodiment method.

Referring now to FIG. 1, there is illustrated a sheet (workpiece) 10 of the invention with a front side F detailed with a center point CP thereof, corners 11, a left edge 12, a right edge 14, a top edge 13 and a bottom edge 15. Firstly, the corners of left edge 12 are curled over $K_O$, that is, towards the center point CP and over the front F of the sheet, while the right edge 14 corners are curled under $K_U$, similar to those of the left edge but towards the back B (not shown) center point. This curling technique may be performed by any of the means known in the art. The next step, shown in FIG. 2 consists in folding one of the lower corners, here the left side 12 lower corner 11, so as to effect by the folding action 16, a crease 18 of 45° that passes through the center point of the sheet 10. Thus, a horizontal centerline CL passing through the document would be folded into a 90° angle with its vertex at the center point. Next, the sheet is rolled along crease or margin 18 in a direction running from an imaginary corner 20 at the lower right of front F towards the imaginary corner 21, the upper left of F. The roll in direction 22 is also denoted R in FIGS. 2 and 3. FIG. 3 goes into more detail regarding the actual process showing how the form of FIG. 2 is rolled along the pinch margin 18 with the aid of a mandrel 23, if required or desired. After the rolling is accomplished, the margin 18 is pinch/crimped carefully to assure its adequate compression but non-mutilation.

Figure 4A:
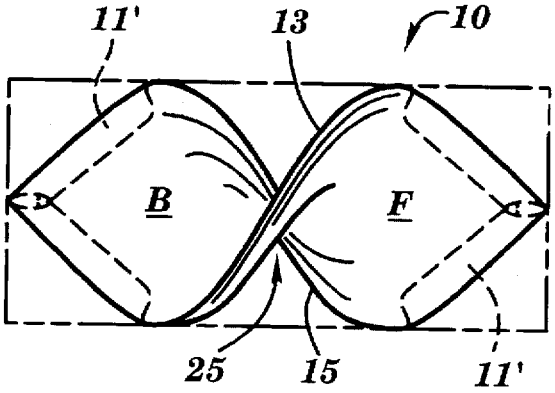
FIG. 4A illustrates an alternate embodiment of the FIG. 2 method.
Figure 4B:
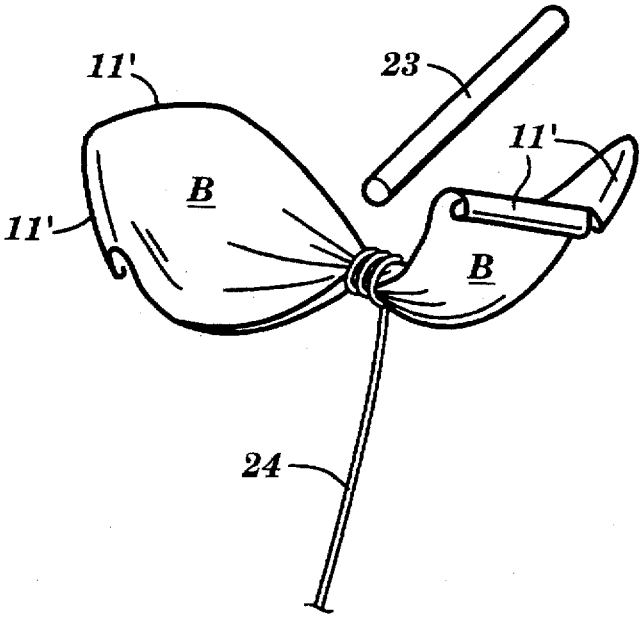
FIG. 4B illustrates another step in the alternate embodiment of the invention method.

FIG. 4A discloses an alternative method for acquiring the essentially tubular shape resulting from the manipulation in FIG. 3. In this alternative method, the preparations as initially disclosed on FIG. 1 are accomplished, that is, the corners are rolled as indicated on the workpiece. Next, a twist 25 is placed at the waist of the sheet 10 so that material therein is gathered and compressed, without mutilation of the sheet, so that one half of the back B is presented adjacent half of the front F of the sheet. This places the curled corners in opposition, but on one side of the workpiece sheet. In FIG. 4B, the twisted waist is further pinch/crimped and may be secured with a light winding or single turn of florist wire 24. Using mandrel 23, or a finger, positioned as shown, each half of this bi-petal device is urged up and around the mandrel 23, spread to wind overlappingly thereabout, while the other petal is treated in the same fashion. After a fairly tight, overlapping wind is performed about the mandrel 23 with both petals, a pseudo-involute formation of an essentially tubular shaped bud is realized. The final step for completing the bud 27 consists in making two or three loops about the pinch/crimp thereby creating a calyx form 26 from which depends a stem wire 24, as shown in FIG. 4C.

Returning to the preferred method, FIG. 5 picks up from the FIG. 3 routine as the margin 18 is tightly pinch/crimped. Thereafter, as FIG. 5 shows, florist wire 24 is wrapped about the pinch/crimp to create the integral calyx form 26, as was realized in the FIG. 4C description. This is an involute formation of an essentially tubular shaped bud, realized by the preferred method.

Figure 4C:
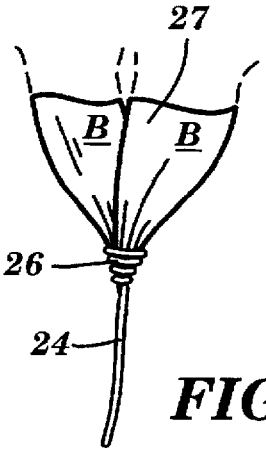
FIG. 4C illustrates a pseudo-involute formation of an essentially tubular shaped bud made by the alternate method.

FIG. 6A commences the steps necessary for acquiring fuller bloom than the bud form acquired in FIGS. 4C and 5. The first distinction over FIG. 1, using the same type of sheet 10, is that the corners 11 are all curled in one direction, preferably curled under $K_U$. At this point we distinguish the instant preparation of a petal pair 28 from the FIGS. 4A–B creation of a bi-petal device. The former is conducive to petal addition, while the latter, because of the ability to flatten a twist and thereby further pinch/compress the material, results in a better pseudo-involute shape necessary for a bud. Continuing in the FIG. 6A description, an accordian gathering G is made at the waist of the sheet and tightly pinched, to be secured by a short wire 30 holding the gather G in a manner resembling an accordion pleating of the prior art. Thereafter, the petal pair is attached to the exposed calyx form 26 of the bud as shown in FIG. 6B. Referring specifically to FIG. 6B, the bud 27 and associated stem wire 24 are shown in phantom, while the petal pair 28 is shown positioned at its pinch-pleat adjacent calyx 26 by the gather G wire 30. The petal pair 28 is urged upward around the bud 27 and its curled corners $K_U$, because of the earlier undercurl applied thereto, now face outward of the bud.

FIG. 7 illustrates a completed artificial rose 40 consisting of bud 27 and one or more petal pairs 28. Whether a bud or a completed flower, a calyx form is always exposed on the stem wire 24 that depends from the last raddled (entwined) structure (here, a gather G). A technique, known in the art consists in wrapping florist tape 32 about the calyx form 26 to acquire a calyx 34 and cover stem 24 and gather G wires 30. The florist tape 32 is then wound down the stem wire 24 and, if desired, leaves 36 are secured by their depending wires 38 onto the stem wire by the tape. The stem wrap and leaf inclusion are techniques well known in the art.

Those of ordinary skill will recognize the value of our method and appreciate the realism imparted by it to the article fashioned herein. Many other non-destructive assembly techniques may exist for making the invention product, but should be used consistent with hereinafter appended claims.

What is claimed is:

1. An artificial flower constructed of at least one non-wetted, rectangular, foldable creasable sheet of material including at least a bud, a stem and a calyx form, comprising the combination of:

a single sheet of said at least one sheet having curled corners and centrally shaped to an integral calyx form defined by an unpleated, pinched and wire-secured portion of said single sheet, and further defined by said curled corners of the said single sheet effecting an essentially involuted tubular shape with outward curling edges; and one or more of said at least one sheet each forming a petal pair having curled corners, a compression along a center portion of said single sheet, securement means to secure said calyx form of the said flower and shaped curvately upward to emulate a rose.

2. The artificial flower of claim 1 wherein said curled corners face outward of the center of said essentially tubular shape.

3. The artificial flower of claim 2 wherein said securement means comprises florist wire.

4. The artificial flower of claim 1 wherein said sheets comprise a negotiable paper.

5. The artificial flower of claim 4 wherein said negotiable paper comprises a national currency.

6. The artificial flower of claim 1 wherein said stem means comprises florist wire.

7. The artificial flower of claim 6 wherein said stem means further comprises florist tape wrapping.

8. The artificial flower of claim 7 wherein said florist tape wrapping includes artificial leaves.

* * * * *